US007485400B2

(12) United States Patent
Veregin et al.

(10) Patent No.: US 7,485,400 B2
(45) Date of Patent: Feb. 3, 2009

(54) DEVELOPER

(75) Inventors: Richard P. N. Veregin, Mississauga (CA); Cuong Vong, Hamilton (CA); Vladislav Skorokhod, Mississauga (CA); Jackie B. Parker, Mississauga (CA); David J. Sanders, Oakville (CA)

(73) Assignee: Xerox Corporation, Norwalk, CT (US)

( * ) Notice: Subject to any disclaimer, the term of this patent is extended or adjusted under 35 U.S.C. 154(b) by 385 days.

(21) Appl. No.: 11/278,762

(22) Filed: Apr. 5, 2006

(65) Prior Publication Data

US 2007/0238040 A1 Oct. 11, 2007

(51) Int. Cl.
*G03G 9/08* (2006.01)

(52) U.S. Cl. ..... 430/107.1; 430/108.7; 430/110.2; 430/111.4; 430/111.1

(58) Field of Classification Search ..... 430/107.1, 430/111.4, 108.3, 108.7, 110.2, 111.1
See application file for complete search history.

(56) References Cited

U.S. PATENT DOCUMENTS 3,847,604 A 11/1974 Hagenbach et al.
4,331,756 A 5/1982 Mayer et al.
4,935,326 A 6/1990 Creatura et al.
4,937,166 A 6/1990 Creatura et al.
5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,496,676 A 3/1996 Croucher et al.
5,501,935 A 3/1996 Patel et al.
5,527,658 A 6/1996 Hopper et al.
5,585,215 A 12/1996 Ong et al.
5,593,807 A 1/1997 Sacripante et al.
5,650,255 A 7/1997 Ng et al.
5,650,256 A 7/1997 Veregin et al.
5,744,520 A 4/1998 Kmiecik-Lawrynowicz et al.
5,747,215 A 5/1998 Ong et al.
5,763,133 A 6/1998 Ong et al.
5,766,818 A 6/1998 Smith et al.
5,827,633 A 10/1998 Ong et al.
5,840,462 A 11/1998 Foucher et al.
5,853,944 A 12/1998 Foucher et al.
5,869,215 A 2/1999 Ong et al.
6,087,059 A * 7/2000 Duggan et al. ..... 430/108.22
6,140,003 A 10/2000 Sacripante et al.
6,319,647 B1 * 11/2001 Gutman et al. ..... 430/111.41
2005/0250031 A1 * 11/2005 McDougall et al. ..... 430/108.6

* cited by examiner

*Primary Examiner*—John L Goodrow
(74) *Attorney, Agent, or Firm*—Oliff & Berridge, PLC

(57) ABSTRACT

A developer includes a carrier and a toner, wherein the toner contains toner particles of at least one binder, at least one colorant, and external additives, wherein the developer has a trimmer clogging value in relation to toner triboelectric charge and toner cohesion expressed according to the equation $$(-0.80+0.039\times(\%\text{ toner cohesion})+0.026\times(\text{toner triboelectric charge})\ (\mu C/g))$$

of less than or equal to about 3.2.

28 Claims, 1 Drawing Sheet

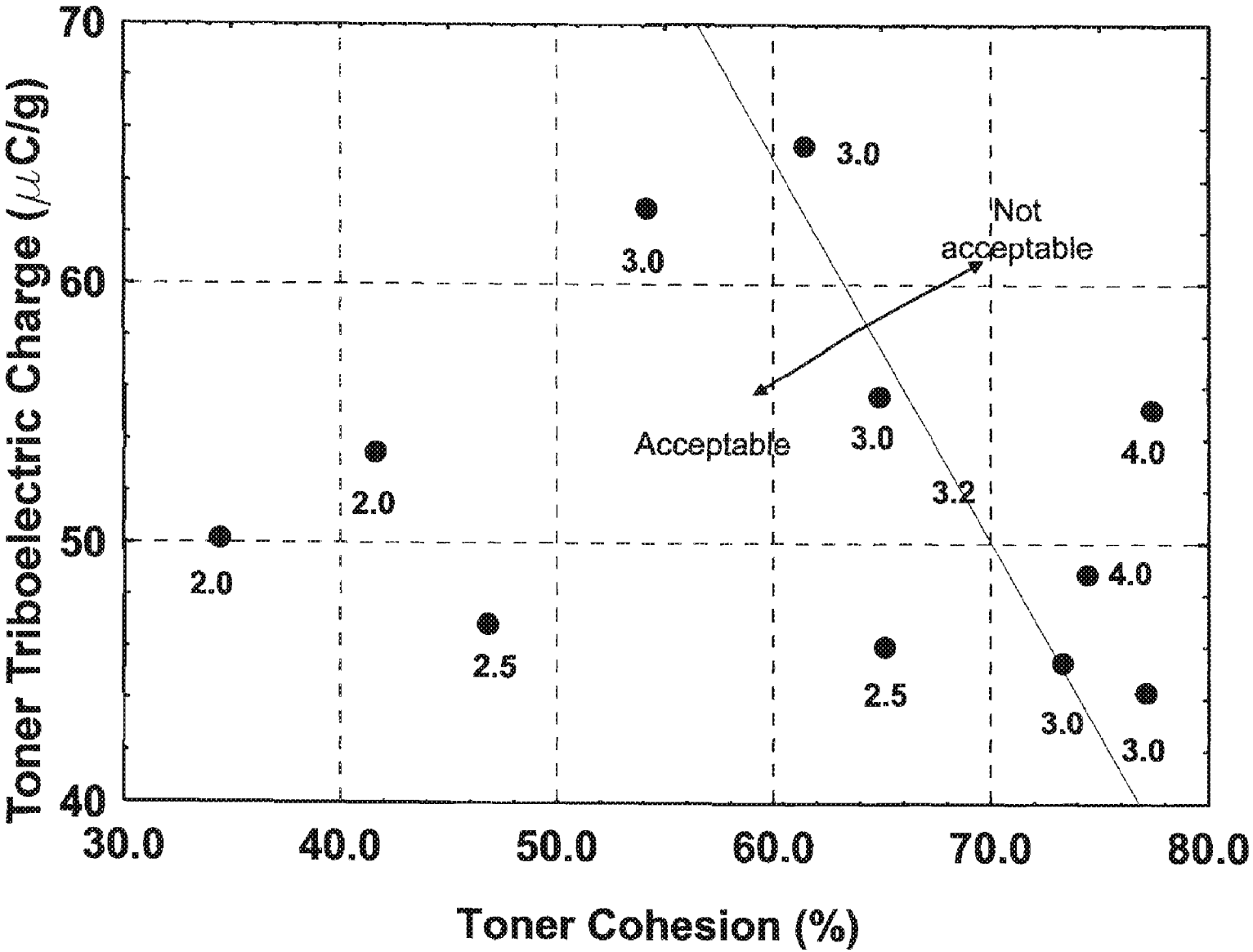
Toner Tribolectric Charge (μC/g)
70
60
50
40
30.0
40.0
50.0
60.0
70.0
80.0
Toner Cohesion (%)
Not acceptable
Acceptable
3.0
3.0
3.0
3.2
4.0
4.0
3.0
3.0
2.5
2.5
2.0
2.0

DEVELOPER

BACKGROUND

This disclosure relates generally to developers for forming and developing images. More particularly, the disclosure is directed to developers that form and develop images of good quality and gloss. The developers provide superior gloss image quality, improved toner concentration sensor response to allow the toner concentration sensor to adequately and accurately measure and control the toner concentration in the developer housing, reduced trimmer clogging failure and improved blocking performance as described further herein.

The developers exhibit many advantages including, for example improved gloss, superior blocking temperature, stable triboelectric charging values, superior developer operation temperature and superior toner concentration, as will be further described herein. The developers may be used in any printing and/or imaging application, including for example electrophotographic, especially xerographic, imaging processes, printing processes, and including color and digital processes.

REFERENCES

Toners and developers containing toners are essential components of any electrophotographic image forming system. In conventional electrophotographic image forming systems, an image is first projected onto a photoreceptor by performing a charging process and an exposure process. An electrostatic latent image is formed on the photoreceptor by first charging developers and then shifting the charged toner particles of the developers to the photoreceptor to develop the electrostatic latent image. Next, the developed electrostatic latent image is transferred onto a recording medium, for example paper. Finally, a fixed electrostatic image is obtained by fusing the toners to the recording medium using heat, pressure and/or light.

One way for developing an electrostatic latent image is a one-component developing process using only a toner. Another way is known as a two-component developing process using a toner and a carrier. In the two-component developing process, the toner and the carrier are mixed to become electrically charged with opposite polarities though triboelectrification.

Emulsion aggregation toners may be used as toners for developers. U.S. patents describing emulsion aggregation toners include. for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,744,520, 5,763,133, 5,766,818, 5,747,215, 5,827,633, 5,853,944, 5,840,462, and 5,869,215.

U.S. Pat. No. 4,331,756, the disclosure of which is totally incorporated herein by reference in its entirely, describes an electrophotographic developer composition containing a mixture of carrier, toner and zinc stearate as a lubricating additive. The electrophotographic developer composition comprising coated carrier particles together with toner particles, the concentration of the toner particles being from 5 to 75 g/kg of carrier particles, and a lubricant additive, the concentration of the lubricant additive being from 0.5 to 1.5% by weight, based on the weight of the toner particles, the surface triboelectric relationship between the surface of the carrier and the surface of the lubricant additive being substantially zero.

A potential problem of the conventional developers that contain emulsion aggregation toners is that developers can form clumps and build up on the auger inside the developer housing. During high volume print runs, heat generated by the system causes the developer housing sump to overheat. Upon exposure to heating, the developers within the developer housing agglomerate and form clumps. These developer clumps can stick to the auger instead of being freely transported in the developer housing for proper image development. As a result, the clumps of developer may cause streaks to developer in the toner image on a recording medium such as paper, resulting in image quality degradation. Such developer clumps can also collect in the area of the toner TC sensor, resulting in an incorrect reading of the toner concentration, so that the toner concentration becomes uncontrolled. This can result in toner undesirably printing in the background of the recording medium.

U.S. Pat. No. 6,319,647, the disclosure of which is totally incorporated herein by reference in its entirety, describes a toner of toner particles containing at least one binder, at least one colorant, and optionally one or more additives, wherein following triboelectric contact with carrier particles comprising a core of ferrite with a coating comprising a polyvinylidenefluoride polymer or copolymer and a polymethyl methacrylate polymer or copolymer, the toner particles exhibit a charge per particle diameter (Q/D) of from 0.6 to 0.9 fC/μm and a triboelectric charge of from 20 to 25 μC/g. The toner particles have an average particle diameter of from 7.8 to 8.3 microns and a melt viscosity of from 35,000 poise to 70,000 poise at 100° C.

SUMMARY

What is desired is a developer that may be advantageously used in magnetic brush development systems, able to produce excellent print quality in varying temperature and humidity environments and over a long period of time without image quality degradation. In addition, also desired is a developer having an improved image gloss, reduced trimmer clogging and improved blocking performance.

In embodiments, described is a developer comprising a carrier and a toner, wherein the toner comprises toner particles of at least one binder, at least one colorant, and external additives, wherein the developer has a trimmer clogging value in relation to toner triboelectric charge and toner cohesion expressed according to the equation $$(-0.80+0.039\times(\%\text{ toner cohesion})+0.026\times(\text{toner triboelectric charge})\ (\mu C/g))$$

of less than or equal to about 3.2.

In embodiments, an electrophotographic image forming apparatus is described that includes a photoreceptor, a semi-conductive magnetic brush development system, and a housing in association with the semi-conductive magnetic brush development system and containing the above developer.

In embodiments, a set of developers for forming a color image is described that comprises a carrier and a cyan toner, a carrier and a magenta toner, a carrier and a yellow toner and a carrier and a black toner, wherein each of the cyan toner, the magenta toner, the yellow toner and the black toner comprise toner particles having at least one binder, at least one colorant, and external additives, wherein each developer has a trimmer clogging value in relation to toner triboelectric charge and toner cohesion expressed according to the equation $$(-0.80+0.039\times(\%\text{ toner cohesion})+0.026\times(\text{toner triboelectric charge})\ (\mu C/g))$$

of less than or equal to about 3.2.

BRIEF DESCRIPTION OF THE DRAWINGS

The FIGURE is a graph of triboelectric charge versus percent cohesion for toners in accordance with an embodiment disclosed herein.

EMBODIMENTS

Electrophotographic printing processes generally involve charging a photoconductive member such as a photoreceptor to a substantially uniform potential in order to sensitize the surface thereof. The charged portion of the photoconductive member is then exposed to a light image to reproduce an original document by a scanning laser beam, an LED source and the like. Exposure of the charged photoconductive member causes the level of electrical charge on the photoconductive member surface to change and results in an electrostatic latent image being recorded on the photoconductive member. After the electrostatic latent image is recorded on the photoconductive member surface, the latent image is developed by bringing a developer material comprising toner particles adhering to carrier granules triboelectrically into proximity therewith. The toner particles are then repelled from the carrier granules and/or attracted to the latent image and adhered to the electrostatic latent image, thereby forming a toner powder image on the photoconductive member. The toner powder image is subsequently transferred from the photoconductive member to a recording medium such as a sheet of paper. The toner powder image may be heated through a fusing process to permanently affix the toner particles to the sheet of paper.

In embodiments, the developers include a carrier and a toner, wherein the toner comprises toner particles of at least one binder, for example from one to four, such as from one to three or from one to two, at least one colorant, for example from one to ten, such as from one to four or from one to two, and external additives, wherein the developer has a trimmer clogging value in relation to toner triboelectric charge and toner cohesion expressed according to the equation $$(-0.80+0.039\times(\%\text{ toner cohesion})+0.026\times(\text{toner triboelectric charge})\ (\mu C/g))$$

of less than or equal to about 3.2.

Any suitable resin binder for use in toner may be employed. Toners prepared by chemical methods such as emulsion/aggregation (E/A) may particularly be used, although toners prepared by physical methods such as grinding may also be employed.

The binder may be a polyester binder, for example made by an emulsion/aggregation (EA) process. Polyester binders are illustrated in a number of patents, such as U.S. Pat. No. 5,593,807, U.S. Pat. No. 5,290,654. U.S. Pat. No. 5,308,734, and U.S. Pat. No. 5,370,963, each of which are incorporated herein by reference in their entirety. The polyester may comprise any of the polyester materials described in the aforementioned references.

In embodiments, the polyester may be a sulfonated polyester, specific examples of which include those as illustrated in U.S. Pat. No. 6,140,003, the disclosure of which is totally incorporated herein by reference, such as a sodio sulfonated polyesters, and more specifically, a polyester, such as poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene-sodio 5-sulfoisophthalate)-copoly-(1,2-propylene-diethylene-terephthalate-phtal ate), copoly(ethylene-neopentylene-sodio 5-sulfoisophthalate)-copoly-(ethylene-neopentylene-terephthalate-phthalate), copoly(propoxylated bisphenol A)-copoly-(propoxylated bisphenol A-sodio 5-sulfoisophthalate) bisphenylene, bis(alkyloxy) bisphenolene, and the like, The polyester may also be an alkali sulfonated polyester resins, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly (ethoxylated bisphenol-A-5-sulfo-isophthalate), and wherein the alkali metal is, for example, a sodium, lithium or potassium ion.

The binder may be a styrene/acrylate binder, for example made by an EA process. Such are illustrated in a number of patents, for example U.S. Pat. Nos. 5,278,020, 5,290,654, 5,308,734, 5,344,738, 5,346,797, 5,364,729, 5,370,963, 5,403,693, 5,418,108, and 5,763,133, the disclosures of each of which are incorporated herein by reference in their entirety. The styrene/acrylate binder may comprise any of the materials described in the aforementioned references, The binder may be derived from monomers or oligomers, and the monomers or oligomers utilized may include any one or more of, for example, butadienes, isoprene, acrylonitrile, acrylic acid, methacrylic acid, beta-carboxy ethyl acrylate, and the like. In addition, the binder may be derived from polymers or copolymers. Illustrative examples of styrene/acrylates include known polymers selected from the group consisting of styrene acrylates, styrene methacrylates, polyesters, poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl ac late-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), and styrene/butyl acrylate/carboxylic acid terpolymers, styrene/butyl acrylate/beta-carboxy ethyl acrylate terpolymers, PLIOTONE™ available from Goodyear, mixtures thereof, and the like.

The binder resin selected, such as styrene acrylates, styrene butadienes, styrene methacrylates, and the like, may be present in various effective amounts, such as from about 50 weight percent to about 98 weight percent, and more specifically, about 70 weight percent to about 95 weight percent, based upon the total weight percent of the toner particles. Prior to aggregation in EA processes, the resin may be of small average particle size, such as from about 0.01 micron to about 1 micron in average volume diameter as measured by the Brookhaven nanosize particle analyzer. Other effective amounts of resin may be selected.

In addition, the binder resin may be derived from more than one type of polymer. For example, two polymer resins may be present in the toner particles, such as a first polymer of styrene methacrylate that may be present in an amount of from about 15 percent to about 30 percent by weight of the toner particles, more specifically from about 20 percent to about 25 percent by weight of the toner particles or from about 25 percent to about 32 percent by weight of the toner particles, with a second polymer of styrene butadiene in an amount of from about 85 percent to about 70 percent by weight of the toner particles, more specifically from about 80 percent to about 75 percent by weight of the toner particles or from about 75 percent to about 70 percent by weight of the toner particles.

The styrene/acrylate binder may comprise, for example, a styrene:butyl acrylate: beta-carboxy ethyl acrylate, wherein, for example, the monomers are present in an amount of about 40% to about 95% styrene, about 5% to about 60% butyl acrylate, and about 0.05 parts per hundred to about 10 parts per hundred beta-carboxy ethyl acrylate; or about 60% to about 85% styrene, about 15% to about 40% butyl acrylate, and about 1 part per hundred to about 5 parts per hundred beta-carboxy ethyl acrylate, by weight based upon the total weight of the monomers or oligomers.

In embodiments, the toner particles may contain a polymer core and a polymer shell that encapsulates the polymer core. The polymer core and the polymer shell may each comprise, for example, a styrene:butyl acrylate beta-carboxy ethyl acrylate, wherein, for example, the monomers are present in an amount of about 40% to about 90% styrene, about 5% to about 60% butyl acrylate, and about 1% to about 10% beta-carboxy ethyl acryl ate; such as about 80% to about 90% styrene, about 10% to about 30% butyl acrylate, and about 2% to about 8% beta-carboxy ethyl acrylate or about 70% to about 85% styrene, about 15% to about 25% butyl acrylate, and about 1% to about 5% beta-carboxy ethyl acrylate, by weight based upon the total weight of the monomers or oligomers.

Additionally, in preparing the toner by the emulsion aggregation procedure, one Or more surfactants may be used in the process. Suitable surfactants may include anionic, cationic and nonionic surfactants.

Anionic surfactants can include, for example, sodium dodecylsulfate (SDS), sodium dodecylbenzene sulfonate, sodium dodecylnaphthalene sulfate, dialkyl benzenealkyl, sulfates and sulfonates, adipic acid, available from Aldrich, NEOGEN RK™, NEOGEN SC™ from Kao, and the like.

Examples of cationic surfactants can include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides. halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a preferred cationic surfactant is SANISOL B-50 available from Kao Corp., which comprises primarily benzyl dimethyl alkonium chloride.

Examples of nonionic surfactants may include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhodia as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, and ANTAROX 897™.

Examples of additional surfactants, which may be added optionally to the aggregate suspension prior to or during the coalescence to, for example, prevent the aggregates from growing in size, or for stabilizing the aggregate size, with increasing temperature can be selected from anionic surfactants such as sodium dodecylbenzene sulfonate, sodium dodecylnaphthalene sulfate, dialkyl benzenealkyl, sulfates and sulfonates, adipic acid, available from Aldrich, NEOGEN R™, NEOGEN SC™ available from Daiichi Kogyo Seiyaku, and the like, among others.

A typical EA process involves the aggregation of a latex (binder resin), colorant like pigment, or dye, and additive particles followed by the fusion of the aggregates into toner particles, and wherein aggregation can be primarily controlled by utilizing a coagulant. In embodiments, the coagulant may be an inorganic coagulant. Inorganic cationic coagulants include, for example, poly-aluminum chloride (PAC), poly-aluminum sulfosilicate (PASS), aluminum sulfate, zinc sulfate, magnesium sulfate, chlorides of magnesium, calcium, zinc, beryllium, aluminum, sodium, other metal halides including monovalant and divalent halides. The coagulant can be present in an aqueous medium in an amount of from, for example, from about 0.05 to about 10 percent by weight, or from about 0.075 to about 5.0 percent by weight of total solids in the toner. The coagulant may also contain minor amounts of other components, for example nitric acid.

In embodiments, polyaluminum chloride (PAC) is used as a coagulant. This coagulant causes crosslinking and hence reduces the gloss. A sequestering agent may then be introduced to sequester or extract a metal complexing ion such as aluminum from the coagulant during the EA process, The final metal ion content in the toner may be in the range of about 250 to about 500 ppm, more specifically from about 300 to about 400 ppm or from about 350 to about 450 ppm.

In embodiments, the sequestering or complexing component may comprise an organic complexing component selected from the group consisting of ethylenediaminetetraacetic acid (EDTA), gluconal, sodium gluconate, potassium citrate, sodium citrate, nitrotriacetate salt, humic acid, and fulvic acid; salts of ethylenediaminetetraacetic acid, gluconal, sodium gluconate, potassium citrate, sodium citrate, nitrotriacetate salt, humic acid, and fulvic acid, alkali metal salts of ethylenediaminetetraacetic acid, gluconal, sodium gluconate, potassium citrate, sodium citrate, nitrotriacetate salt, humic acid, and fulvic acid; sodium salts of ethylenediaminetetraacetic acid, gluconal, sodium gluconate, tartaric acid, gluconic acid, oxalic acid, polyacrylates, sugar acrylates, citric acid, potassium citrate, sodium citrate, nitrotriacetate salt, humic acid, and fulvic acid; potassium salts of ethylenediaminetetraacetic acid, gluconal, sodium gluconate, potassium citrate, sodium citrate, nitrotriacetate salt, humic acid, and fulvic acid; and calcium salts of ethylenediaminetetraacetic acid, gluconal, sodium gluconate, potassium citrate, sodium citrate, nitrotriacetate salt, humic acid, fulvic acid, calcium disodium ethylenediaminetetraacetate dehydrate, diammoniumethylenediaminetetraacetic acid, pentasodium diethylenetriaminepentaacetic acid sodium salt, trisodium N-(hydroxyethyl)-ethylenediaminetriacetate, polyasparic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, nitrilo triacetic acid sodium salt, thiamine pyrophosphate, farnesyl pyrophosphate, 2-aminoethylpyrophosphate, hydroxyl ethylidene-1,1-diphosphonic acid, aminotrimethylenephosphonic acid, diethylene triaminepentamethylene phosphonic acid, ethylenediamine tetramethylene phosphonic acid, and mixtures thereof.

In embodiments, the sequestering or complexing component may comprise an inorganic complexing component selected from the group consisting of sodium silicate, potassium silicate, magnesium sulfate silicate, sodium hexameta phosphate, sodium polyphosphate, sodium tripolyphosphate, sodium trimeta phosphate, sodium pyrophosphate, bentonite, and talc, and the like. Organic and inorganic complexing components can be used in an amount of about 0,01 weight percent to about 10 weight percent, such as from about 0.4 weight percent to about 8 weight percent or from about 5 weight percent to about 10 weight percent based upon the total weight of the toner.

Furthermore, the toner compositions may also include suitable waxes, for example as a release agent. In embodiments, a suitable wax may be polyethylene, polypropylene, paraffin, Fischer-Tropsch, microcrystalline wax, carnauba wax, jojoba wax, rice wax, beeswax, montanic acid ester wax, castor wax, and mixtures thereof. In embodiments, the wax is a polyethylene wax or a Fischer Tropsch wax, and in specific embodiments, fractionated, crystalline, and/or distilled polyethylene wax. The polyethylene wax, in embodiments, is derived from ethylene polymerization. A toner composition having a crystalline or distilled polyethylene wax is illustrated in, for example, U.S. patent application Ser. No. 11/274,459, filed Nov. 14, 2005, entitled, "Toner Having Crystalline Wax," the disclosure of which is totally incorporated herein by reference in its entirety.

In embodiments, the wax comprises a wax in the form of a dispersion comprising, for example, a wax having a particle diameter of about 100 nanometers to about 500 nanometers, or about 100 nanometers to about 300 nanometers, water, and an anionic surfactant or a polymeric stabilize, and optionally a nonionic surfactant. In embodiments, the wax comprises polyethylene wax particles, such as POLYWAX® 655, or POLYWAX® 725, POLYWAX® 850, POLYWAX® 500 (the POLYWAX® waxes being commercially available from Baker Petrolite) and, for example, fractionated/distilled waxes which are cuts of commercial POLYWAX® 655 designated here as X1214, X1240, X1242, X1244, and the like, but are not limited to POLYWAX® 655 cuts. Waxes providing a specific cut, that meet the viscosity/temperature criteria, wherein the upper limit of viscosity is 10,000 cps and the melting point temperature upper limit is 100° C., can be used. The waxes can have a particle diameter in the range of from about 100 to about 500 nanometers, although not limited. Other examples include FT-100 waxes from Shell (SMDA), and FNP0090 (trade name) from Nippon Seiro. The surfactant used to disperse the wax can be an anionic surfactant, although not limited thereto, such as, for example, NEOGEN RK® commercially available from Daiichi Kogyo Seiyaku or TAYCAPOWER® BN2060 commercially available from Tayca Corporation or DOWFAX available from DuPont.

The wax may be present in the toner composition in various amounts. However, generally the wax may be present in the toner composition in an amount of from about 5 percent by weight to about 25 percent by weight, for example in an amount of from about 5 percent by weight to about 15 percent by weight or from about 8 percent by weight to about 10 percent by weight, based on the weight of the toner composition.

In embodiments, colorants may be pigments, dye, mixtures of pigment and dyes, mixtures of pigments, mixtures of dyes, and the like. A dye is a substance that is used to color material. The term "color" may encompass a number of aspects such as hue, lightness and saturation, where one color may be different from another color if the two colors differ in at least one of these aspects. For example, two colors having the same hue and saturation but different in lightness would be consider different colors. Any suitable colors such as, for example, red, white, black, gray, yellow, cyan, magenta, blue and purple, can be used to produce a color. Various known colorants, such as pigments, may be present in the toner in an amount of, for example, from about 1 to about 25 percent by weight of toner, such as in an amount of from about 3 to about 10 percent by weight or from about 5 to about 20 percent by weight.

Examples of suitable colorants for making toners include carbon black such as REGAL 330®; magnetites, such as Mobay magnetites MO8029™, MO8060™, Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected, for example, various known cyan, magenta, yellow, red, green, brown, blue colorants or mixtures thereof. Specific examples of pigments include phthalocyanine HELIOGEN BLUE L16900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan, magenta, yellow components may also be selected as pigments. The colorants, such as pigments, selected can be flushed pigments as indicated herein. Colorant examples farther include Pigment Blue 15:3 having a Color Index Constitution Number of 74160, Magenta Pigment Red 81:3 having a Color Index Constitution Number of 45160:3, and Yellow 17 having a Color Index Constitution Number of 21105, and known dyes such as food dyes, yellow, blue, green, red, magenta dyes, and the like. Colorants include pigments, dyes, mixtures of pigments, mixtures of dyes, mixtures of dyes and pigments, and the like, and preferably pigments.

Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions commercially available from Clariant include HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta E02, which can be dispersed in water and/or surfactant prior to use.

In embodiments, the colorant, for example carbon black, cyan, magenta and/or yellow colorant, may be incorporated in an amount sufficient to impart the desired color to the toner. In general, pigment or dye, may be employed in an amount ranging from about 2% to about 35% by weight of the toner particles on a solids basis, more specifically, from about 5% to about 25% by weight or from about 5% to about 15% by weight. In embodiments, more than one colorant may be present in the toner particles. For example, two colorants may be present in the toner particles, such as a first colorant of pigment blue that may be present in an amount ranging from about 2% to about 10% by weight of the toner particles on a solids basis, more specifically, from about 3% to about 8% by weight or from about 5% to about 10% by weight, with a second colorant of pigment yellow that may be present in an amount ranging from about 5% to about 20% by weight of the toner particles on a solids basis, more specifically from about 6% to about 15% by weight or from about 10% to about 20% by weight.

In embodiments, the toner particles are blended with an external additive package using a blender such as a Henschel blender. External additives are additives that associate with the surface of the toner particles. In embodiments, the external additive package may include one or more of silicon dioxide or silica ($SiO_2$), titania or titanium dioxide ($TiO_2$), and cerium oxide. Silica may be a first silica and a second silica. The first silica may have an average primary particle size, measured in diameter, in the range of, for example, from about 5 nm to about 50 nm, such as from about 5 nm to about 25 nm or from about 20 nm to about 40 nm. The second silica may have an average primary particle size, measured in diameter, in the range of, for example, from about 100 nm to about 200 nm, such as from about 100 nm to about 150 nm or from about 125 nm to about 145 nm. The second silica external additive particles have a larger average size (diameter) than the first silica. The titania may have an average primary particle size in the range of, for example, about 5 nm to about 50 nm, such as from about 5 nm to about 20 nm or from about 100 nm to about 50 nm. The cerium oxide may have an average primary particle size in the range of, for example, about 5 nm to about 50 nm, such as from about 5 nm to about 20 nm or from about 10 nm to about 50 nm.

Zinc stearate may also be used as an external additive. Calcium stearate and magnesium stearate may provide similar functions. Zinc stearate may have an average primary particle size in the range of, for example, about 500 nm to about 700 nm, such as from about 500 nm to about 600 nm or from about 550 nm to about 650 nm.

In embodiments, the external additive package may comprise a first silica, a second silica, titania, an optional cerium oxide and an optional zinc stearate.

In general, the first silica is applied to the toner surface for toner flow, tribo enhancement, admix control, improved development and transfer stability and higher toner blocking temperature. Titania is applied for improved relative humidity (RH) stability, triboelectric control and improved development and transfer stability. Cerium oxide is used for improving the powder flowability and the charge controllability. Zinc stearate is applied to provide developer conductivity and tribo enhancement, both due to its lubricating nature. In addition, zinc stearate enables higher toner charge and charge stability by increasing the number of contacts between toner and carrier particles. The second silica is applied to reduce toner cohesion, stabilize the toner transfer efficiency, reduce/minimize development falloff characteristics associated with toner aging, and stabilize triboelectric charging characteristics and charge through. The second silica external additive particles have an ultra large particle size as discussed below, and are present on the surface of the toner particles, thereby functioning as spacers between the toner particles and carrier particles and hence reducing the impaction of smaller conventional toner external surface additives such as the first silica and/or titania during aging in the development housing. The spacers thus stabilize developers against disadvantageous burial of conventional smaller sized toner external additives by the development housing during the imaging process in the development system. The ultra large external additives, such as the aforementioned second silica, function as a spacer-type barrier, and therefore the smaller conventional toner external additives of, for example, silica and titania, are shielded from contact forces that have a tendency to embed them in the surface of the toner particles. The ultra large external additive particles thus provide a barrier and reduce the burial of smaller sized toner external surface additives, thereby rendering a developer with improved flow stability and hence excellent development and transfer stability during copying/printing in xerographic imaging processes. The toner compositions having the aforementioned external additive package exhibit an improved ability to maintain their DMA (developed mass per area on a photoreceptor), their TMA (transferred mass per area from a photoreceptor) and acceptable triboelectric charging characteristics and admix performance for an extended number of imaging cycles.

The first silica may be present in the toner particles in amounts of, for example, from about 0.5% to about 2.5% by weight of the toner particles, such as from about 1.5% to about 1.8% or from about 1.6% to about 1.9% by weight of the toner particles. The second silica may be present in the toner particles in amounts of, for example, from about 0.5% to about 2% by weight of the toner particles, such as from about 1.5% to about 1.8% or from about 1.6% to about 1.9% by weight of the toner particles. The titania may be present in the toner particles in amounts of, for example, from about 0.5% to about 2% by weight of the toner particles, such as from about 0.5% to about 1.5% or from about 0.6% to about 0.9% by weight of the toner particles. The cerium oxide may be present in the toner particles in amounts of, for example, from about 0.2% to about 1% by weight of the toner particles, such as from about 0.3% to about 0.7% or from about 0.5% to about 1% by weight of the toner particles. The zinc stearate may be present in the toner particles in amounts of, for example, from about 0.1% to about 1% by weight of the toner particles, such as from about 0.1% to about 0.5% or from about 0.3% to about 0.8% by weight of the toner particles.

In embodiments, the first silica may be surface treated with polydimethylsiloxane. Such a treated silica is commercially available as RY50 from Nippon Aerosil. The second silica is untreated silica, such as sol-gel silicas. Examples of such sol-gel silicas include, for example, X24, available from Shin-Etsu Chemical Co., Ltd. Other suitable treated fumed silicas are commercially available as TS530 from Cabot Corporation, Cab-O-Sil Division. The titania may be either treated or untreated. Untreated titania is available as P25 from Degussa. In embodiments, the titania may be surface treated, for example with a decylsilane that is commercially available as MT3103, or as SMT5103, both available from Tayca Corporation. The titania may also be surface treated, for example with a decyltrimethoxysilane which is commercially available as JMT2000. A commercially available zinc stearate is known as ZINC STEARATE L™, obtained from Ferro Corporation.

In embodiments, the external additive package may be applied to the toner surface with the total coverage of the toner ranging from, for example, about 20% to about 60% surface area coverage (SAC), such as from about 20% to about 40% or from about 30% to about 60%. Another metric relating to the amount and size of the additives is "SAC×Size" ((percentage surface area coverage) times (the primary particle size of the additive in nanometers)), for which the additives may have a total SAC×Size range between, for example, about 500 to about 4,000, such as from about 1000 to about 3000 or from about 500 to about 1500.

It is desirable that toners and developers be functional under a broad range of environmental conditions to enable good image quality from a printer. Thus, it is desirable for toners and developers to function at low humidity and low temperature, for example at 10° C. and 15% relative humidity (denoted herein as C-zone), at moderate humidity and temperature, for example at 21° C. and 40% relative humidity (denoted herein as B-zone), and high humidity and temperature, for example at 28° C. and 85% relative humidity (denoted herein as A-zone).

For good performance under a broad range of conditions, properties of the toner and developer should change as little as possible across environmental zones described as A-zone, B-zone and C-zone. If there is a large difference across these zones, the materials may have a large relative humidity (RH) sensitivity ratio, which means that the toner may show performance shortfalls in the extreme zones, either at low temperature and humidity, or high temperature and humidity, or both. In embodiments, a RH sensitivity ratio may be expressed as a ratio of a triboelectric charge of the toner developer in the C-zone to a triboelectric charge of the toner developer in A-Zone. A goal is for the RH sensitivity ratio to be as close to one as possible. When such an RH sensitivity ratio is achieved the toner may be equally effective in both high humidity and low humidity conditions. Stated another way, the toner has low sensitivity to changes in RH. In embodiments, the RH sensitivity ratio may be in the range from about 1 to about 2, for example from about 1.1 to about 1.7 or from about 1.1 to about 1.5.

In the process of electrophotographic printing, the step of conveying toner to the latent image on the photoreceptor, is known as development. The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads (particles). The toner particles adhere triboelectrically to the relatively large carrier particles, which are typically made of steel.

The developer composition may be included in an electrostatographic/xerographic device such as an eletrophotographic image forming apparatus in order to form an image upon an image receiving member such as a photoreceptor. An embodiment of an electrophotographic image forming apparatus includes a phtotoreceptor, a semi-conductive magnetic brush development system, and a housing in association with the conductive magnetic brush development system and containing the developer. A semi-conductive magnetic brush development (SCMB) system, which uses semiconductive carriers, advances the developer material into contact with the electrostatic latent image. When the developer material is placed in a magnetic field, the carrier granules (particles) with the toner particles thereon form what is known as a magnetic brush, wherein the carrier beads form relatively long chains, which resemble the fibers of a brush. This magnetic brush is typically created by means of a developer roll in the form of a cylindrical sleeve rotating around a fixed assembly of permanent magnets. The carrier granules form chains extending from the surface of the cylindrical sleeve. The toner particles are electrostatically attracted to the chains of carrier granules. The rotation of the sleeve transports magnetically adhered developer material comprising carrier granules and toner particles and allows direct contact between the developer brush and a belt having a photoconductive surface. The electrostatic latent image attracts the toner particles from the carrier granules forming a toner power image on the photoconductive surface of the belt.

In embodiments, the developer may be formed by mixing toner particles with one or more carrier particles. Carrier particles that can be selected for mixing with the toner include, for example, those carriers that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, the entire disclosure of which is hereby incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby incorporated herein by reference. In embodiments, the carrier particles may have an average particle size of from, for example, about 20 to about 85 μm, such as from about 30 to about 60 μm or from about 35 to about 50 μm.

In embodiments, the carrier may have a carrier resistivity of, for example from about $10^6$ to about $10^{11}$ ohm-cm, such as from about $10^6$ to about $10^9$ ohm-cm or from $10^7$ to about $10^9$ ohm-cm. Carrier resistivities may be measured at 21° C. and 40% relative humidity. To determine carrier resistivities, 30 g of carrier powder was sandwiched between two circular planar stainless steel electrodes with a diameter of 6 cm. The height of the carrier pile was adjusted to approximately 5 mm. A load of 4 kilograms (kg) was applied to the upper electrode. The circular electrodes were connected to the leads of an HP4339A high-resistance meter to measure the electrical resistance of the carrier pile at an applied voltage of 10 V. A resulting carrier resistivity was calculated by multiplying the measured electrical resistance by the electrode surface area and divided by the pile height.

In embodiments, carrier particles can be mixed with the toner particles in various suitable combinations. The toner concentration in each developer ranges from, for example, about 2% to about 10% by weight of the total weight of the developer, such as from about 2% to about 8% by weight of the total weight of the developer or from about 5% to about 10% by weight of the total weight of the developer. The carrier particles in each developer may be in the range from about 90% to about 98% by weight of the total weight of the developer, such as from about 90% to about 95% by weight of the total weight of the developer or from about 93% to about 97% by weight of the total weight of the developer.

After mixing toner particles with one or more carrier particles to form developers, a number of toner properties may be measured, these properties may include but not limited to toner cohesion and toner triboelectric charge. The aforementioned properties may affect the properties of the developers, which in turn, may result in image quality degradation over time.

Toner cohesion may be measured using a Hosokawa Micron PT-R tester, available from Micron Powders Systems. Toner cohesion is typically expressed in percent (%) cohesion. Percent cohesion may be measured by placing a known mass of toner, for example 2 grams, on top of a set of stacked screens, for example a top screen that has 53 micron mesh or openings, a middle screen that has 45 micron mesh or openings, and a bottom screen that has 38 micron mesh or openings, and vibrating the screens and toner for a fixed time at a fixed vibration amplitude, for example for 90 seconds at 1 millimeter vibration amplitude. All screens are made of stainless steel. In embodiments, the percent cohesion is calculated as follows:

$$\%\ \text{cohesion}=50\cdot A+30\cdot B+10\cdot C$$

where A is the mass of toner remaining on the 53 micron screen. B is the mass of toner remaining on the 45 micron screen, and C is the mass of toner remaining on the 38 micron screen. The percent cohesion of the toner is related to the amount of toner remaining on each of the screens at the end of the time. A percent cohesion value of 100% corresponds to all the toner remaining on the top screen at the end of the vibration step and a percent cohesion of 0% corresponds to all of the toner passing through all three screens, in other words, no toner remaining on any of the three screens at the end of the vibration step. The greater the percent cohesion for toners, the less the toner particles are able to flow. In embodiments, the toners may have a percent cohesion in the range of, for example, from about 30% to about 80%, such as from about 35% to about 75%, or from about 40% to about 65%.

Another property associated with the toners of the present disclosure is the triboelectric charge of the toner particles. In embodiments, the toners may also have a triboelectric charge in the range of; for example, from about 30 μC/g to about 70 μC/g, such as from about 40 μC/g to about 60 μC/g, or from about 35 μC/g to about 55 μC/g. Triboelectric charge may be obtained by placing 2.4 grams of toner to a 4 oz. glass jar containing 30 grams of the carriers for example Xerox WorkCentre Pro C3545 carrier. The jar with toner and carrier is then conditioned at 21C and 40% relative humidity for at least 1 hour. The jar is placed on a paintshaker and shaken for 10 minutes. Triboelectric charge of the developer may then be obtained by the total blow-off method at 55 psi air pressure.

Both the percent cohesion of toners and toner triboelectric charge may be associated with the trimmer clogging failure, which is a property associated with the high-gloss developers of the present disclosure. High gloss refers, for example, to the gloss of a material being greater than about 20 gloss units, such as about 30 gloss units. In embodiments, the toners herein, may exhibit a high gloss of from about 30 to about 90 gloss units (GGU), such as from about 40 to about 70 GGU or from about 45 to about 75 GGU, as measured by the Gardner Gloss metering unit; for example on a coated paper, such as Xerox 120 gsm Digital Coated Gloss papers, or on plain paper such as Xerox 90 gsm Digital Color Xpressions+ paper.

Trimmer clogging failure mode is a test used to evaluate the maximum operation temperature of the developer. During a prolonged print run, the developer housing sump can reach temperatures of up to about 52° C., for example from about 48° C. to about 52° C. This temperature range is generally known as an overheating condition for the developers. The overheating results in the developers forming clumps and building up on the transporting auger. The clumping of the developers and the sticking of the developers to the transporting auger instead of the developers being freely transported in the developer housing, in turn, results in unacceptable image quality, for example a white streak may occur along the process direction of a recording medium such as paper if the developer clumps come loose from the transporting auger and get stuck in the trim bar which has the function to remove excess developer material from the magnetic brush roll.

By way of an example, in order to evaluate a developer for the trimmer clogging failure, a developer was run in a Xerox DC2240 SCMB developer housing that was conditioned at 48° C. for one hour in an oven, followed by a one-hour off-line run at 350 rpm in the oven. The final temperature in the housing may increase further to about 52° C., for example from about 52° C. to about 53° C., during the test.

After the run was completed, the developer was examined visually for agglomerates and build up on the transporting auger, and assigned a visual rating of 1 to 6:

1 represents developer agglomerates <3 mm in size that occupy <10% of the surface of the developer sump;

2 represents developer agglomerates 3-5 mm in size that occupy 10-30% of the surface of the developer sump;

3 represents developer agglomerates 5-7 mm in size that occupy 30-50% of the surface of the developer sump;

4 represents developer agglomerates 7-20 mm in size that occupy 50-90% of the surface of the developer sump;

5 represents 50-90% of the developer adheres to and wraps around the auger and thus cannot be propelled by auger rotation; and 6 represents >90% of the developer adheres to and wraps around the auger and thus cannot be propelled by auger rotation.

Thus, a 1 indicates very little noticeable agglomeration, whereas a value of 6 indicates almost all the developer is agglomerated and cannot be propelled by the auger. While it may be ideal to have as low a rating as possible, more specifically a rating 1, it is acceptable to have some small amount of small clumps such as from about 5 millimeters (mm) to about 7 mm in the developer, which corresponds to a rating of 3. A rating of 4 with generation of larger clumps such as greater than 20 mm may not be considered as acceptable. Thus, acceptable performance may have a rating of less than or equal to about 3, for example from about 1 to about 3.

A statistical analysis of trimmer clogging values data, toner cohesion data and the toner triboelectric charge data found that trimmer clogging values increase with increasing toner cohesion and increasing toner triboelectric charge. Thus, a relationship among trimmer clogging value, toner cohesion and toner triboelectric charge may be established to summarize the result of the statistical analysis. The relationship may be expressed according to the equation $$\text{trimmer clogging value}=(-0.80+0.039\times(\%\text{ toner cohesion})+0.026\times(\text{toner triboelectric charge})\ (\mu C/g)).$$

In addition, as shown in Figure, the statistical analysis also indicates that the acceptable trimmer clogging values can be assured to 95% confidence if the trimmer clogging value is less than or equal to about 3.2, for example from about 0.1 to about 3.2 or from about 1 to about 3.

As can be seen from Table 1, trimmer clogging values increase with increasing percent cohesion and increasing toner triboelectric charge.

A is a blending condition where toner particle and external additives were blended for 15 minutes at 3000 rpm with no cooling of the blender jacket. B is a blending condition where toner particle and external additives were blended for 15 minutes at 3000 rpm and blender jacket cooling with water. C is a blending condition where toner particle and external additives were blended for 5 minutes at 3000 rpm and blender jacket cooling with water.

seconds having 1 mm peak-to-peak vibration amplitude. The amount of toner remaining on screen A and screen B are weighed. The blocking cohesion is then measured by using the formula $$\text{blocking cohesion}=100\cdot(A+B)/m.$$

The blocking procedure is typically repeated with fresh toner at a temperature of 1° C. higher than the temperature for the previous blocking cohesion measurement. Each calculated blocking cohesion is then plotted against each corresponding temperature. Under the conditions of the blocking test, a toner that has not yet blocked shows percent toner cohesion of less than about 10% to 15%. The blocking temperature may be defined as the highest temperature step before there is a large continuous increase of cohesion. In other words, the blocking temperature is a temperature when the toner has greater than 20% cohesion increase within a 1° C. temperature rise. Thus, the blocking temperature for proper operations of high-gloss developers may be in the range of from about 52° C. to about 55° C., such as from about 52° C. to about 54° C., or from about 53° C. to about 55° C. (See Table 2 below).

TABLE 1

Trimmer Clogging Data

| Toner particle | Blend Conditions | Wax | Colorant | % Cohesion | Toner Triboelectric Charge (μC/g) | Trimmer Clogging Value |
|---|---|---|---|---|---|---|
| 1 | A | 9% Polyethylene | Magenta | 41.7 | 53.5 | 2.0 |
| 2 | A | 9% Polyethylene | Black | 34.4 | 50.1 | 2.0 |
| 3 | C | 11% distilled Polyethylene | Cyan | 65.1 | 46.0 | 2.5 |
| 4 | C | 11% distilled Polyethylene | Black | 46.9 | 46.8 | 2.5 |
| 5 | A | 9% Polyethylene | Cyan | 61.5 | 65.3 | 3.0 |
| 6 | B | 9% Polyethylene | Cyan | 77.2 | 44.3 | 3.0 |
| 7 | C | 11% distilled Polyethylene | Magenta | 64.9 | 55.7 | 3.0 |
| 8 | A | 9% Polyethylene | Yellow | 54.2 | 63.0 | 3.0 |
| 9 | C | 11% distilled Polyethylene | Yellow | 51.9 | — | 3.0 |
| 10 | B | 11% distilled Polyethylene | Black | 73.3 | 45.4 | 3.0 |
| 11 | B | 11% distilled Polyethylene | Magenta | 77.4 | 55.2 | 4.0 |
| 12 | B | 11% distilled Polyethylene | Yellow | 74.4 | 48.8 | 4.0 |

In embodiments, the toner may not only have reduced toner cohesion that results in reduced trimmer clogging failure, but may also have higher blocking temperatures that lead to reduced auto toner control (ATC) sensor failure and improved image quality. Blocking temperatures are determined based on a blocking procedure. The blocking procedure measures the toner cohesion at varying elevated temperatures to determine the temperature at which the toner of the developer starts to stick together due to exposures to elevated temperature. For each temperature measurement, by way of an example, a fresh sample of toner is sieved through a 106 micron mesh screen to remove any large agglomerates. A mass of sieved toner sample is weighed into a dish. The toner sample is conditioned at the desired temperature in a controlled oven, at 50% relative humidity for 17 hours. The toner sample is then removed from the oven and cooled for 30 minutes before measurement. A blocking procedure is then performed in order to obtain blocking cohesion. By way of an example, a knower mass of the toner, expressed as m, for example 5 grams of toner, are placed on a top screen A that has 1000 micron mesh, and a second screen B is situated below screen A and has 105 micron mesh. Both screens sit in a Hosokawa Micron flow tester. In each case, 5 grams of toner was placed on the top screen A and then vibrated for 90

Another property associated with the high-gloss developers of the present disclosure is the developer density. Developer density is a mass of the developer over a given volume. Developer density may be measured using a Carney funnel. The general procedure is described in ASTM standard test method ASTM B417-00 "Apparent Density of Non-Free-Flowing Metal Powders Using the Carney Funnel." By way of an example, an empty cup of volume 25 $cm^3$ is weighed and tared to zero on a balance. Then approximately 30 to 40 $cm^3$ of the developer may be loaded into the Carney funnel. The developer may then pass through the funnel into the empty cup, overfilling the cup in the process. The excess developers from the top of the cup may be removed using the straight edge of a spatula to level the developer flush with the top of the cup. The mass of the developer may then be measured by weighing the cup that is completely filled with developer. Finally, developer density may be calculated by dividing the mass of the developer by the volume of the cup.

In embodiments, the developer density may have a significant effect on the image quality of an image reproduced onto a recording medium such as paper. The image quality may be measured by mottle. Mottle is a measure of how much lightness changes within the print of the reproduced image. By way of an example, in order to test the image quality of an image reproduced onto paper with the use of the high-gloss developer of the present disclosure, toners were print tested in a Xerox WorkCenter Pro C3545 and ran for 45,000 prints. The results showed that toners generally have acceptable mottle, which corresponds to excellent image quality and aforementioned high-gloss when the developer density is greater than 1.6 g/cm$^3$, for example from about 1.6 g/cm$^3$ to about 1.75 g/cm$^3$ or from about 1.7 g/cm$^3$ to about 1.8 g/cm$^3$. Images only show unacceptable mottle when the amount of replenisher in the replenish bottle was low and the developer density is smaller than 1.6 g/cm$^3$, for example 1.585 g/cm$^3$. Mottle is known to result when a low mass of developer is present in the magnetic brush such as a semi-conductive magnetic brush. Thus, the low developer density combined with the low replenisher condition may result in unacceptable mottle of the image copies. The analysis of the print results leads to the conclusion that, for robust image quality throughout the life of the replenisher bottle, it is required for the developer to have a developer density of greater than 1.6 g/cm$^3$ to ensure that sufficient mass of developer is present in the magnetic brush to provide acceptable mottle under varying printing conditions and over a long period of time.

Yet another property associated with the high-gloss developers of the present disclosure is the toner concentration sensor failure. If the sensor fails to detect toner concentration (TC) accurately, then poor TC control and significant TC fluctuations will result (excessive clouding is also more likely to occur at higher TC). TC sensor failure occurs when developers build up in the region around the TC sensor. TO evaluate toner concentration sensor failure, an Imari MF DC2240 printer may be used with a Kutani DC3545 developer housing. The failure is most likely to occur under humid conditions, so the test is done at 28° C. and 85% relative humidity. The toner area coverage on the print was 5% for each color and a total of 10,000 prints were run. During the print test, the TC increased from 6% to 12% using software control for the TC sensor. Actual TC was measured directly by sampling developer from the sump of the housing. The TC sensor failure was recorded as the TC at which TC control was lost. All the developers evaluated passed the minimum requirement of 9.5% TC before recording TC sensor failure, and thus are acceptable.

Still another property associated with the high-gloss developers of the present disclosure is the toner clouding failure. Emission of toner aerosol from the developer housing during printing is a condition known as toner clouding. Such condition causes toner to build up inside various parts of the machine, which can contaminate key components causing image quality defects, or causing background on the photoreceptor or on the prints. Thus, it is desirable to keep the emission of toner to a sufficiently low level to prevent image degradation. To evaluate this problem. toner was run in an Imari MF DC2240 printer. TC was first decreased and measured to calibrate the TC sensor. The housing was then removed and run off-line at 350 rpm. TC was then increased by manually adding toner to the developer housing through the dispenser port at a rate of 2 g/min and the amount of toner clouding was measured with a Dust Trak Aerosol Monitor Model 8520 manufactured by TSI Incorporated and plotted with TC. TC at which an emitted aerosol reading of 1 mg/m$^3$ was measured was taken as the failure point. In order to keep the emission of toner to a sufficient low level to prevent image degradation, it is important to have a TC of at least 9.5% without exceeding the level of 1 mg/mm$^3$ of emitted toner, for example about 9.5% to about 20% TC or about 10% to about 12% TC. The result of the toner clouding measurement data shows that all developers evaluated passed the minimum requirement of 9.5% TC before recording toner clouding failure (when the emitted aerosol reading exceeds 1 mg/m$^3$), and thus have acceptable toner emission levels.

In embodiments, a developer having the aforementioned properties, may comprise a carrier and a toner, wherein the toner comprises toner particles of a core comprising at least one core binder and at least one colorant, a shell comprising at least one shell binder, external additives and a wax. The carrier may comprise carrier particles having an average particle size of from about 25 microns to about 35 microns and in the amount of from about 85% to about 95% by weight of the total weight of the developer. The core binder may comprise a styrene:butyl acrylate:beta carboxy ethyl acrylate in an amount of about 75% to about 80% styrene, about 20% to about 30% butyl acrylate, and about 1% to about 5% beta carboxy ethyl acrylate, by weight based upon the total weight of the monomers or oligomers. The shell binder may comprise a styrene:butyl acrylate:beta carboxy ethyl acrylate in an amount of about 80% to about 90% styrene, about 15% to about 20% butyl acrylate, and about 1% to about 5% beta carboxy ethyl acrylate. The colorant or colorants may be employed in an amount ranging from about 1% to about 8% by weight of the toner particles on a solids basis.

In addition, the external additive package includes a first silica with a mass of about 1.6% to about 1.8% by weight of the toner particles and an average primary particle size (in diameter) of from about 20 nm to about 40 nm, a second silica with a mass of about 1.6% to about 1.8% by weight of the toner particles and an average primary particle size (in diameter) of from about 100 un to about 150 nm, a titania with a mass of about 0.7% to about 0.9% by weight of the toner particles and an average primary particle size (in diameter) of from about 10 nm to about 50 nm, an optional cerium oxide with a mass of about 0.4% to about 0.6% by weight of the toner particles and an average primary particle size (in diameter) of from about 20 nm to about 40 nm, and an optional zinc stearate with a mass of about 0.15% to about 0.25% by weight of the toner particles and an average primary particle size (in diameter) of from about 125 nm to about 145 nm.

Furthermore, the wax may be a polyethylene wax having about 6% to about 13% by weight based on the weight of the toner particles or a distilled polyethylene wax having about 6% to about 13% by weight of the toner particles.

As can be seen from Table 2, the developers of the present disclosure, may exhibit TC sensor failure as measured by TC of at least 9.5%, such as in the range from about 9.5% to about 12%, and thus pass the minimum requirement of 9.5% TC. The toner clouding measurement data also shows that these developers, may exhibit a toner clouding as measured in TC of at least 9.5%, such as in the range from about 9.5% to about 11%, and thus pass the minimum requirement of 9.5% TC.

A is a blending condition where toner particle and external additives were blended for 15 minutes at 3000 rpm with no cooling of the blender jacket. B is a blending condition where toner particle and external additives were blended for 15 minutes at 3000 rpm and blender jacket cooling with water. C is a blending condition where toner particle and external additives were blended for 5 minutes at 3000 rpm and blender jacket cooling with water.

TABLE 2

Toner Sensor Failure, Toner Cloud and Blocking Temperature Data

| Toner particle | Blend Conditions | Wax | Colorant | TC Sensor Failure (% TC) | Toner Cloud (% TC) | Blocking Temperature (° C.) |
|---|---|---|---|---|---|---|
| 1 | A | 9% Polyethylene | Magenta | 11.0% | 9.5% | 55 |
| 2 | A | 9% Polyethylene | Black | 12.0% | 11.0% | 53 |
| 3 | C | 11% distilled Polyethylene | Cyan | — | — | 53 |
| 4 | C | 11% distilled Polyethylene | Black | — | — | 54 |
| 5 | A | 9% Polyethylene | Cyan | 12.0% | 9.5% | 53 |
| 6 | B | 9% Polyethylene | Cyan | 11.0% | 10.0% | 52 |
| 7 | C | 11% distilled Polyethylene | Magenta | — | — | 53 |
| 8 | A | 9% Polyethylene | Yellow | 11.0% | 10.0% | 53 |
| 9 | C | 11% distilled Polyethylene | Yellow | — | — | 53 |
| 10 | B | 11% distilled Polyethylene | Black | 9.5% | 9.0% | 53 |
| 11 | B | 11% distilled Polyethylene | Magenta | 12.0% | 10.0% | 53 |
| 12 | B | 11% distilled Polyethylene | Yellow | 12.0% | 10.0% | 53 |

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A developer comprising a carrier and a toner, wherein the toner comprises toner particles of at least one binder, at least one colorant, and external additives including a first silica, a second silica, a titania, an optional cerium oxide, and an optional zinc stearate, wherein the developer has a trimmer clogging value in relation to toner triboelectric charge and toner cohesion expressed according to the equation $$(-0.80+0.039\times(\%\text{ toner cohesion})+0.026\times(\text{toner triboelectric charge})\ (\mu C/g))$$

of less than or equal to about 3.2, wherein the first silica is about 0.5% to about 2.5% by weight of the toner particles, the second silica, differing at least in an average diameter from the first silica, is about 0.5% to about 2% by weight of the toner particles, the titania is about 0.5% to about 2% by weight of the toner particles, the optional cerium oxide, when present, is about 0.2% to about 1% by weight of the toner particles, and the optional zinc stearate, when present, is about 0.1% to about 1% by weight of the toner particles, and wherein a surface area coverage of the toner particles by the external additives is from about 20% to about 60%.

2. The developer of claim 1, wherein the trimmer clogging value is from about 1 to about 3.

3. The developer of claim 1, wherein the toner particles further comprises a wax.

4. The developer of claim 3, wherein the wax is about 5% to about 25% by weight of the toner particles.

5. The developer of claim 3, wherein the wax is about 6% to about 13% by weight of the toner particles, the first silica is about 1.6% to about 1.8% by weight of the toner particles, the second silica differing at least in an average diameter from the first silica is about 1.6% to about 1.8% by weight of the toner particles, the titania is about 0.7% to about 0.9% by weight of the toner particles, the optional cerium oxide, when present, is about 0.4% to about 0.6% by weight of the toner particles, and the optional zinc stearate, when present, is about 0.15% to about 0.25% by weight of the toner particles, and the colorant is about 1% to about 8% by weight of the toner particles.

6. The developer of claim 1, wherein the first silica has an average diameter of from about 20 nm to about 40 nm, the second silica has an average diameter of from 100 nm to about 150 nm, the titania has an average diameter of from 10 nm to about 50 nm, the optional cerium oxide, when present, has an average diameter of from 20 nm to about 40 nm, and the optional zinc stearate, when present, has an average diameter of from 100 nm to about 150 nm.

7. The developer of claim 3, wherein the wax is selected from the group consisting of polyethylene, polypropylene, paraffin, Fischer-Tropsch, microcrystalline wax, carnauba wax, jojoba wax, rice wax, beeswax, montanic acid ester wax, castor wax, and mixtures thereof.

8. The developer of claim 3, wherein the wax is a distilled wax.

9. The developer of claim 1, wherein the carrier of the developer has a carrier resistivity of from about $10^6$ to about $10^{11}$ ohm-cm, and the developer has a developer density of greater than about 1.6 g/cm$^3$.

10. The developer of claim 1, wherein the carrier of the developer has a carrier resistivity of from about $10^7$ to about $10^9$ ohm-cm, and the developer has a developer density of from about 1.6 g/cm$^3$ to about 1.75 g/cm$^3$.

11. The developer of claim 1, wherein the toner has a blocking temperature of from about 50° C. to about 65° C.

12. The developer of claim 1, wherein the toner has a blocking temperature of from about 52° C. to about 55° C.

13. The developer of claim 1, wherein the toner further includes a core and a shell structure, wherein the core comprises the at least one binder as a core binder and the at least one colorant, and wherein the shell comprises at least one shell binder.

14. The developer of claim 13, wherein the shell binder is present in an amount of from about 10 to about 40 weight percent of the toner, and the core binder is present in an amount of from about 20 to about 90 weight percent of the toner.

15. The developer of claim 13, wherein the core binder and the shell binder each comprise an emulsion aggregation styrene/butylacrylate/beta carboxy ethyl acrylate binder or a polyester binder.

16. The developer of claim 1, wherein the toner has a percent toner cohesion from about 10% to about 78%.

17. The developer of claim 1, wherein the toner has a percent toner cohesion from about 45% to about 75%.

18. The developer of claim 1, wherein the toner has a toner triboelectric charge from about 40 μC/g to about 70 μC/g.

19. The developer of claim 1, wherein the carrier comprises a core and at least one polymer coated thereover.

20. The developer of claim 19, wherein the carrier core is selected from the group consisting of iron, ferrites, magnetite, steel, nickel and mixtures thereof.

21. The developer of claim 1, wherein the toner has a toner concentration of at least 9.5% without exceeding an emitted toner density level of 1 mg/ml3.

22. The developer of claim 1, wherein the toner has a toner concentration of from about 9.5% to about 20% without exceeding an emitted toner density level of 1 mg/m3.

23. An electrophotographic image forming apparatus comprising:

a photoreceptor, a semi-conductive magnetic brush development system, and a housing in association with the semi-conductive magnetic brush development system and containing a developer comprising a carrier and a toner, wherein the toner comprises toner particles of at least one binder, at least one colorant, and external additives including a first silica, a second silica, a titania, an optional cerium oxide, and an optional zinc stearate, wherein the developer has a trimmer clogging value in relation to toner triboelectric charge and toner cohesion expressed according to the equation $$(-0.80+0.039\times(\%\text{ toner cohesion})+0.026\times(\text{toner triboelectric charge})\ (\mu C/g))$$

of less than or equal to about 3.2, wherein the first silica is about 0.5% to about 2.5% by weight of the toner particles, the second silica, differing at least in an average diameter from the first silica, is about 0.5% to about 2% by weight of the toner particles, the titania is about 0.5% to about 2% by weight of the toner particles, the optional cerium oxide, when present, is about 0.2% to about 1% by weight of the toner particles, and the optional zinc stearate, when present, is about 0.1% to about 1% by weight of the toner particles, and wherein a surface area coverage of the toner particles by the external additives is from about 20% to about 60%.

24. The electrophotographic image forming apparatus of claim 23, herein images formed by the apparatus have an image gloss of from about 30 to about 90 GGU.

25. The electrophotographic image forming apparatus of claim 23, wherein images formed by the apparatus have an image gloss of from about 45 to about 75 GGU.

26. A set of developers for forming a color image, comprising:

a carrier and a cyan toner, a carrier and a magenta toner, a carrier and a yellow toner and a carrier and a black toner, wherein each of the cyan toner, the magenta toner, the yellow toner and the black toner comprise toner particles having at least one binder, at least one colorant, and external additives including a first silica, a second silica, a titania, an optional cerium oxide, and an optional zinc stearate, wherein the developer has a trimmer clogging value in relation to toner triboelectric charge and toner cohesion expressed according to the equation $$(-0.80+0.039\times(\%\text{ toner cohesion})+0.026\times(\text{toner triboelectric charge})\ (\mu C/g))$$

of less than or equal to about 3.2, wherein the first silica is about 0.5% to about 2.5% by weight of the toner particles, the second silica, differing at least in an average diameter from the first silica, is about 0.5% to about 2% by weight of the toner particles, the titania is about 0.5% to about 2% by weight of the toner particles, the optional cerium oxide, when present, is about 0.2% to about 1% by weight of the toner particles, and the optional zinc stearate, when present, is about 0.1% to about 1% by weight of the toner particles, and wherein a surface area coverage of the toner particles by the external additives is from about 20% to about 60%.

27. The set of developers of claim 26, wherein the trimmer clogging value is from about 1 to about 3.

28. The developer of claim 1, wherein the toner has a relative humidity sensitivity ratio of from about 1 to about 2.

* * * * *